United States Patent [19]

Aoki et al.

[11] 4,416,237

[45] Nov. 22, 1983

[54] METHOD AND AN APPARATUS FOR CONTROLLING THE AIR-FUEL RATIO IN AN INTERNAL COMBUSTION ENGINE

[75] Inventors: Keiji Aoki; Masaki Mitsuyasu, both of Susono, Japan

[73] Assignee: Toyota Jidosha Kogyo Kabushiki Kaisha, Toyota, Japan

[21] Appl. No.: 352,457

[22] Filed: Feb. 25, 1982

[30] Foreign Application Priority Data

Feb. 26, 1981 [JP] Japan ..... 56-26066

[51] Int. Cl.[3] ..... F02B 3/00

[52] U.S. Cl. ..... 123/438; 123/478; 123/480

[58] Field of Search ..... 123/438, 436, 440, 478, 123/480; 364/431.06

[56] References Cited

U.S. PATENT DOCUMENTS

| | | | |
|---|---|---|---|
| 4,269,156 | 5/1981 | Drellishak | 123/478 |
| 4,270,503 | 6/1981 | Pomerantz | 123/438 |
| 4,313,412 | 2/1982 | Hosaka et al. | 123/480 |
| 4,314,534 | 2/1982 | Nakajina et al. | 123/478 |
| 4,314,537 | 2/1982 | Asano et al. | 123/438 |
| 4,319,327 | 3/1982 | Nigashiyama et al. | 123/480 |
| 4,348,727 | 9/1982 | Kobayashi et al. | 123/480 |
| 4,373,187 | 2/1983 | Ishii et al. | 123/480 |
| 4,377,145 | 3/1983 | Nagashai | 123/478 |

*Primary Examiner*—Raymond A. Nelli

*Attorney, Agent, or Firm*—Cushman, Darby & Cushman

[57] ABSTRACT

The pulse-width of the fuel injection signal is controlled, depending upon the running speed and the intake manifold pressure, and corrected by the transient correction factor, which is determined in accordance with the transient operating condition, and the A/F correction factor, which is determined the air-fuel ratio condition. The map used for obtaining the transient correction factor from the transient operating condition is corrected depending upon the converging state of the A/F correction factor by the learning control operation.

10 Claims, 9 Drawing Figures

70
IS A/F RICH ?
NO
YES
71
72
FAF←FAF-A
FAF←FAF+B
73
IS A/F SIGNAL JUST INVERTED ?
NO
YES
75
FSKIP←"1"
76
IS A/F SIGNAL INVERTED FROM RICH TO LEAN ?
NO
YES
77
78
FAF←FAF+C
FAF←FAF-D
74
STORE FAF

METHOD AND AN APPARATUS FOR CONTROLLING THE AIR-FUEL RATIO IN AN INTERNAL COMBUSTION ENGINE

BACKGROUND OF THE INVENTION

The present invention relates to a method and an apparatus for controlling the air-fuel ratio in an internal combustion engine under transient operating conditions.

There is known a closed-loop control method for controlling the air-fuel ratio, which method repeats the following process so that the air-fuel ratio in the engine will finally lie within a predetermined range. First, the running speed of the engine and the intake manifold pressure are detected. Then, a basic pulse-width of the injection signal applied to a fuel injection valve is calculated, depending upon the detected speed and pressure. This basic pulse-width of the injection signal is corrected in accordance with an air-fuel ratio correction factor, which is calculated from a detection signal produced by a concentration sensor for detecting a particular component, such as an oxygen component, in the exhaust gas. Hereinafter, this concentration sensor is referred to as an $O_2$ sensor. In accordance with the corrected pulse-width, the actual fuel feeding rate to the engine is adjusted.

According to the above-mentioned method for controlling the air-fuel ratio, it is possible to control the air-fuel ratio so as to lie within a very narrow range in the vicinity of the stoichiometric air-fuel ratio and, hence, it is possible to maintain high levels of the functions of the three-way catalytic converter installed in the exhaust system to simultaneously remove three harmful components, such as CO, HC and NOx, contained in the exhaust gas.

In general, the air-fuel ratio can be converged within a desired range by the above-mentioned feedback control method only when the engine is under steady-state operating conditions. However, when the throttle valve is quickly operated, i.e., when the engine is under the transient operating conditions (an accelerating or decelerating condition), the air-fuel ratio after being controlled is often greatly deviated from the stoichiometric air-fuel ratio, either toward the lean side or the rich side, for a moment. This momentary change in the controlled air-fuel ratio is usually called an air-fuel ratio spike (lean spike or rich spike). During the period of acceleration, for example, the lean spike develops to a considerable degree, due to the lag in controlling the amount of fuel injection relative to the change in the amount of the intake air or due to the lag in intaking the injected fuel into the combustion chamber. The rich spike, on the other hand, takes place during the period deceleration. The air-fuel ratio spikes deteriorate the purifying functions of the three-way catalytic converter. Particularly, large lean spikes deteriorate the operation characteristics of the engine.

In order to eliminate the above-mentioned inconveniences under the conditions of the transient operation, a method has been proposed to increase or decrease the amount of fuel by a predetermined amount during the periods of acceleration or deceleration. According to this method, however, the amount of fuel is increased or decreased always by a predetermined value during the periods of acceleration or deceleration. Consequently, the increment or decrement of fuel is often deviated from an optimum value, due to variance in the quality of parts constituting the engines, due to the aging or due to the environmental changes. To determine the increment or decrement when designing the engine, a variety of values must be used to find the optimum values. With the conventional method, therefore, considerable periods of time and labor are required for designing the system.

SUMMARY OF THE INVENTION

It is, therefore, an object of the present invention to provide a method and an apparatus for controlling the air-fuel ratio in an internal combustion engine, whereby an optimum air-fuel ratio can be maintained, even under transient operating conditions, irrespective of the variance in the control characteristics of the engine or of the change in the characteristics due to aging or the environment.

Another object of the present invention is to provide a method and an apparatus for controlling the air-fuel ratio in an internal combustion engine, whereby the fuel increment or decrement, under the transient operating conditions, can be very easily determined at the stage of designing the air-fuel ratio control system.

According to the present invention, a method for controlling the air-fuel ratio in an internal combustion engine comprises the steps of: detecting the running speed of the engine for producing a first electrical signal which indicates the detected speed; detecting the intake manifold pneumatic pressure of the engine for producing a second electrical signal which indicates the detected pressure; detecting the concentration of a predetermined component in the exhaust gas for producing a third electrical signal which indicates the detected concentration; detecting the degree of the acceleration or deceleration of the engine for producing a fourth electrical signal which indicates the detected acceleration or deceleration degree; calculating, depending upon the first and second electrical signals, a value which corresponds to a basic fuel feeding rate to the engine; calculating, depending upon the third electrical signal, a first correction factor which corresponds to the deviation of the actual air-fuel ratio in the engine from a desired air-fuel ratio; judging, depending upon the fourth electrical signal, whether or not the engine is under the accelerating or decelerating condition; when the engine is under the acceleration or decelerating condition, calculating, depending upon the fourth electrical signal, a second correction factor by using a function which represents a relationship between the acceleration or deceleration degree and the second correction factor; correcting the calculated value related to the fuel feeding rate in accordance with the calculated first correction factor; when the engine is under the accelerating or decelerating condition, correcting the corrected value related to the fuel feeding rate in accordance with the calculated second correction factor; adjusting, depending upon the corrected value related to the fuel feeding rate, the actual fuel feeding rate to the engine; repeating the above sequence of steps so that the actual air-fuel ratio in the engine is controlled within a predetermined range; detecting the change of the first correction factor during the accelerating or decelerating condition; and correcting, in response to the detected change of the first correction factor, the above-mentioned function related to the second correction factor.

Furthermore, according to the present invention, an apparatus for controlling the air-fuel ratio in an internal combustion engine comprises: means for detecting the running speed of the engine for producing a first electrical signal which indicates the detected speed; means for detecting the intake manifold pneumatic pressure of the engine for producing a second electrical signal which indicates the detected pressure; means for detecting the concentration of a predetermined component in the exhaust gas for producing a third electrical signal which indicates the detected concentration; means for detecting the degree of the acceleration or deceleration of the engine for producing a fourth electrical signal which indicates the detected acceleration or deceleration degree; processing means for (1) calculating, depending upon the first and second electrical signals, a value which corresponds to a basic fuel feeding rate to the engine; (2) calculating, depending upon the third electrical signal, a first correction factor which corresponds to the deviation of the actual air-fuel ratio in the engine from a desired air-fuel ration, (3) judging, depending upon the fourth electrical signal, whether or not the engine in under the accelerating or decelerating condition; (4) when the engine is under the accelerating or decelerating condition, calculating, depending upon the fourth electrical signal, a second correction factor by using a function which represents a relationship between the acceleration or deceleration degree and the second correction factor; (5) correcting the calculated value related to the fuel feeding rate in accordance with the calculated first correction factor and (6) when the engine is under the accelerating or decelerating condition, correcting the corrected value related to the fuel feeding rate in accordance with the calculate second correction factor; means for adjusting, depending upon the corrected value related to the fuel feeding rate, the actual fuel feeding rate to the engine; means for detecting the change of the first correction factor during the accelerating or decelerating condition; and means for correcting, in response to the detected change of the first correction factor, the above-mentioned function related to the second correction factor.

The above and other related objects and features of the present invention will be apparent from the description of the present invention set forth below, with reference to the accompanying drawings, as well as from the appended claims.

DETAILED DESCRIPTION OF THE PREFERRED EMBODIMENT

Figure 1:
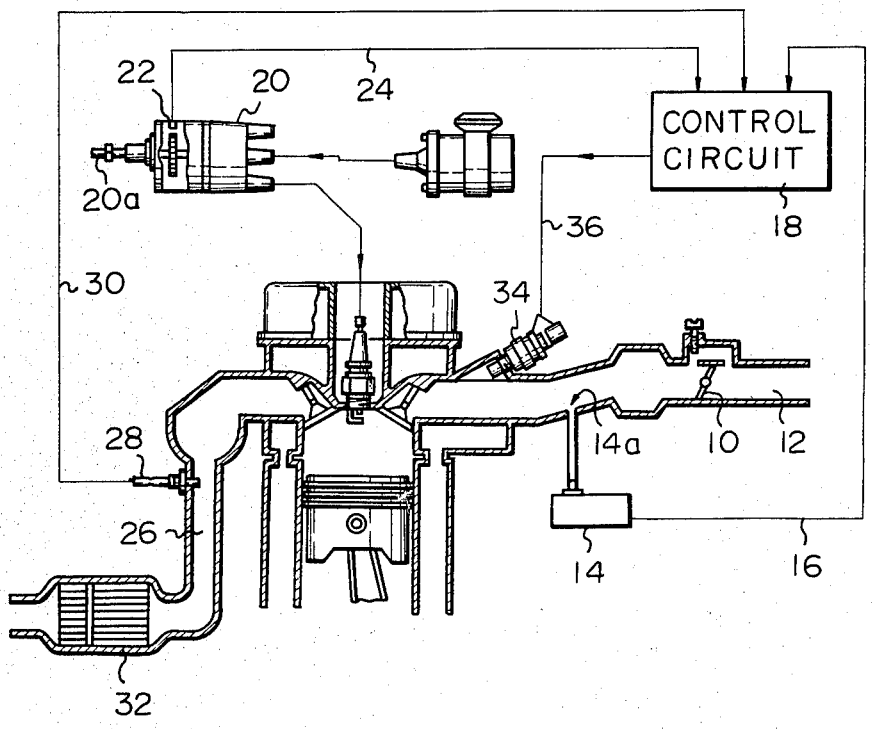
FIG. 1 is a schematic diagram illustrating an electronic fuel injection control system of an internal combustion engine, according to the present invention.

Referring to FIG. 1, reference numeral 10 denotes a throttle valve provided in an intake passage 12 of an internal combustion engine. In the intake passage 12, downstream of the throttle valve 10, a pressure take-out port 14*a* is attached to a pneumatic pressure sensor 14, which sensor 14 detects the absolute pneumatic pressure in the intake manifold and produces a voltage corresponding to the detected pressure. The output voltage produced by the pneumatic pressure sensor 14 is fed to a control circuit 18 via a line 16.

A distributor 20 of the engine is equipped with a crank angle sensor 22 which produces an angular position signal every time the distributor shaft 20*a* rotates by a predetermined angle, for example, 30° in terms of the crank angle. The angular position signal from the crank angle sensor 22 is fed to the control circuit 18 via a line 24.

An exhaust passage 26 of the engine is equipped with an $O_2$ sensor 28. The $O_2$ sensor 28 produces an output responsive to the oxygen concentration in the exhaust gas, i.e., produces a different voltage depending upon whether the air-fuel ratio is on the lean side or on the rich side relative to the stoichiometric air-fuel ratio. The output voltage of the $O_2$ sensor 28 is fed to the control circuit 18 via a line 30.

A three-way catalytic converter 32 is provided in the exhaust passage 26 on the downstream side of the $O_2$ sensor 28 to simultaneously remove HC, CO and NOx, which are three harmful components contained in the exhaust gas.

A single or a plurality of fuel injection valves 34 are served with injection signals sent from the control circuit 18 via a line 36. The injection valve 34 thus injects compressed fuel, supplied from a fuel supply system (not shown), into a portion of the intake port.

Figure 2:
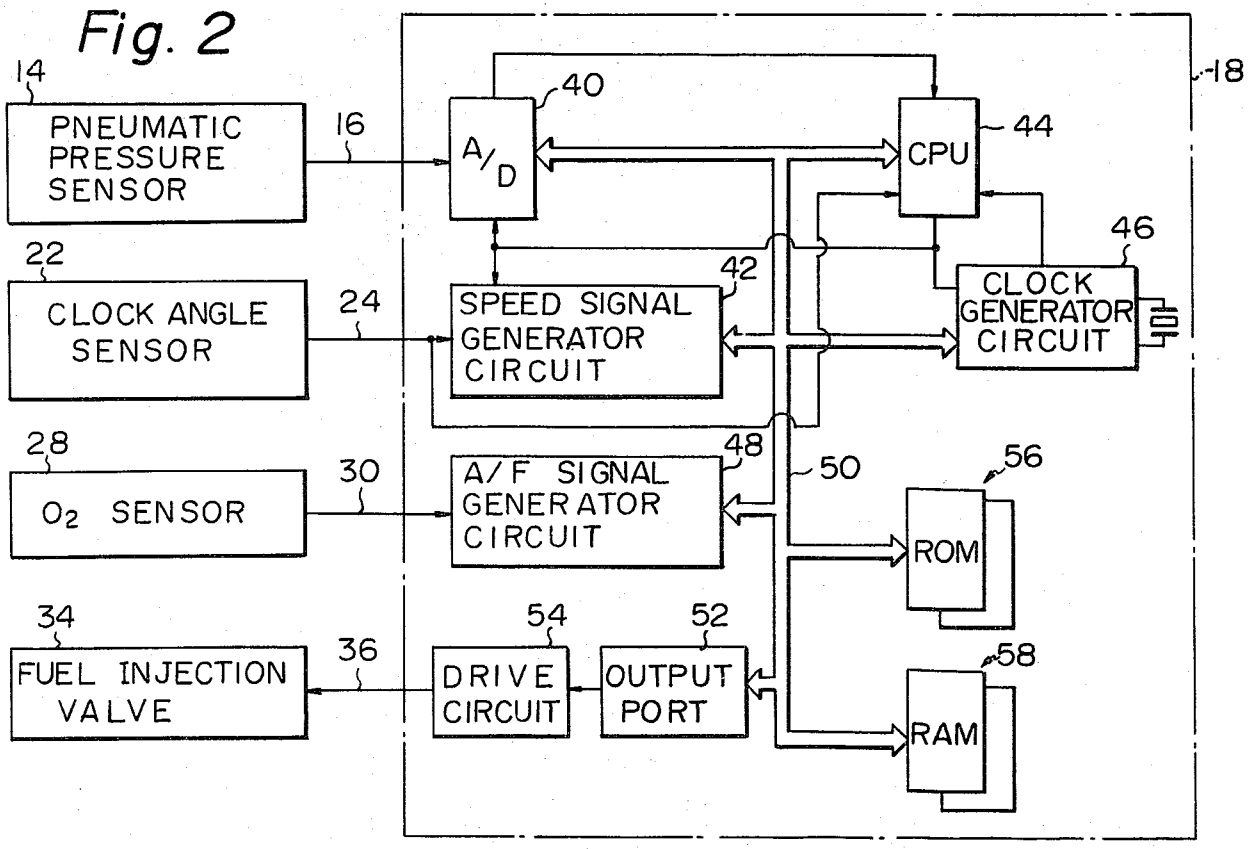
FIG. 2 is a block diagram illustrating the control circuit shown in FIG. 1.

FIG. 2 is a block diagram illustrating an example of the control circuit 18 of FIG. 1.

The output voltages from the pneumatic pressure sensor 14 are sent, together with voltages from other sensors (not shown), to A/D converter 40, which includes an analog multiplexer, and these output voltages are converted into binary signals at a predetermined conversion period successively or in a specified order.

The angular position signal produced by the crank angle sensor 22 at every crank angle of 30° is fed to a speed signal generator circuit 42, and is further fed to a central processing unit (CPU) 44 as an interrupt signal for synchronizing the crank angle. The speed signal generator circuit 42 has a gate that is opened and closed by the signal produced at every crank angle of 30° and a counter which counts the number of clock pulses that pass through the gate, which clock pulses are produced by a clock generator circuit 46. The speed signal generator circuit 42 further produces a binary speed signal having a value that corresponds to the running speed of the engine.

The output voltage of the $O_2$ sensor 28 is fed to an A/F signal generator circuit 48 which has a comparator for comparing the output voltage of the $O_2$ sensor 28 with a reference voltage and a latch circuit for temporarily storing the output of the comparator. The A/F signal generator circuit 48 forms a binary A/F (air-fuel ratio) signal of "1" or "0" that indicates whether the air-fuel ratio of the engine is on the lean side or on the rich side relative to the stoichimetric air-fuel ratio.

An injection signal having a pulse-width $\tau$ is fed to a predetermined position of an output port 52 from the CPU 44 via a bus 50. The drive current corresponding to the injection signal is sent to the fuel injection valve 34. Accordingly, the fuel injection valve 34 is energized for a time $\tau$, and the fuel, of an amount corresponding to the time $\tau$, is supplied into a combustion chamber of the engine.

The A/D converter 40, speed signal generator circuit 42, A/F signal generator circuit 48, and output port 52 are connected via the bus 50 to the CPU 44, read-only memory (ROM) 56, random access memory (RAM) 58, and clock generator circuit 46 which constitute the microcomputer. The input/output data are transferred through the bus 50. Although not diagrammed in FIG. 2, the microcomputer is further provided with an input-/ouput control circuit and a memory control circuit, in the customary manner.

In the ROM 56 have been stored beforehand control programs for executing the main processing routine, that will be mentioned later, and a variety of data and constants necessary for executing the processing.

Below is briefly mentioned the processing steps for controlling the fuel injection (for controlling the air-fuel ratio) using the microcomputer, in conjunction with FIG. 3. When the power-supply circuit is turned on, the CPU 44 executes an initializing routine 60 to reset the contents of the RAM 58 and to set the constants to initial values. The program then proceeds to a main routine 62 which repetitively executes calculation of the fuel feeding rate, that will be mentioned later, calculation of the A/F correction factor, calculation of the acceleration or deceleration correction factor, and operation of the learing control. The CPU 44 further executes an interrupt routine 64 responsive to the crank angle interrupt signal produced at every crank angle of 30°, to form an injection signal, and sends it to the output port 52, or executes an interrupt routine 66 responsive to a timer interrupt signal produced at each predetermined period to form the injection signal and sends it to the output port 52.

While the main processing routine is being executed or while some other interrupt routine is being executed, the CPU 44 introduces the new data that represents the running speed N of the engine, received from the speed signal generator circuit 42, and stores it in a predetermined region in the RAM 58. Further, relying upon the A/D conversion interrupt routine, executed at each predetermined period of time or at every predetermined crank angular position, the CPU 44 introduces new data, that represents the absolute pneumatic pressure P in the intake manifold of the engine, and stores it in a predetermined region of the RAM 58.

Figure 3:
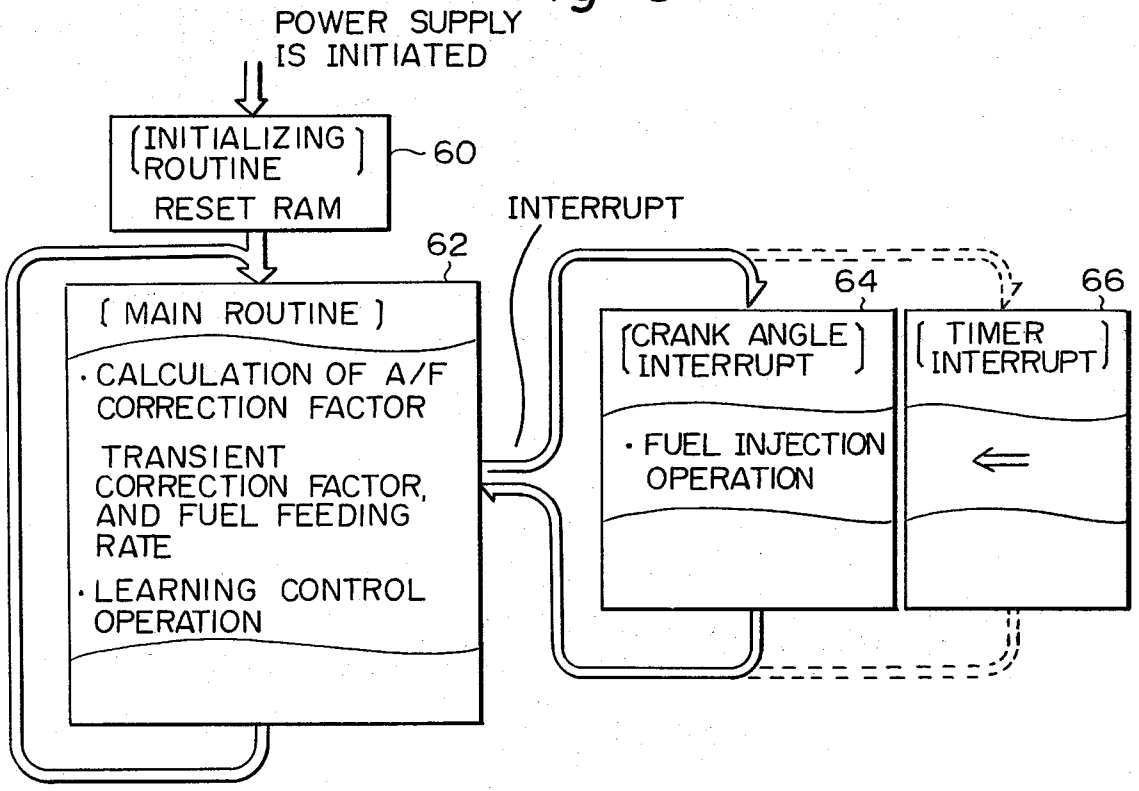
FIG. 3 is a schematic flow diagram illustrating the control programs of the microcomputer in the control circuit of FIG. 2.
Figure 4:
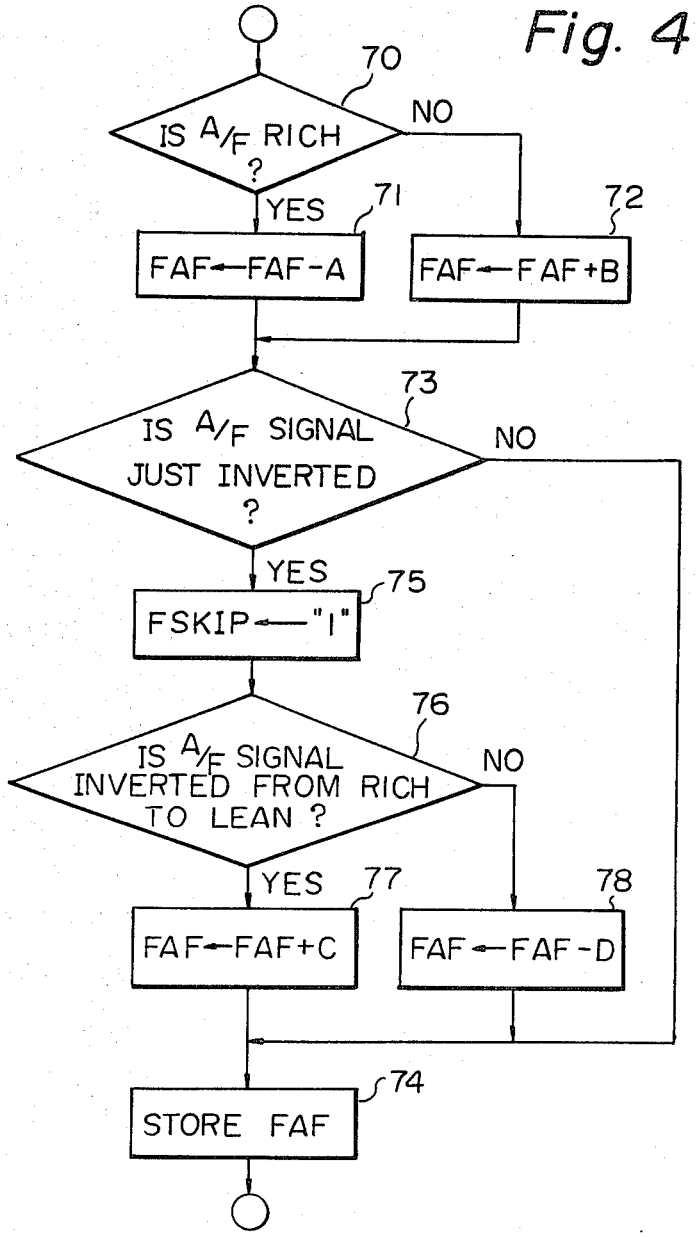
FIGS. 4 and 5 are flow diagrams illustrating parts of the control programs shown in FIG. 3.

FIG. 4 illustrates part of the main routine 62 of FIG. 3. The routine of FIG. 4 is to calculate an A/F correction factor FAF. At a point 70, first, the CPU 44 checks the logic level of the A/F signal from the A/F signal generator circuit 48 to discriminate whether the present A/F (air-fuel ratio) in the engine is on the rich side or on the lean side with respect to the stoichiometric air-fuel ratio. When the A/F is on the rich side, the program proceeds to a point 71 where the A/F correction factor FAF is subtracted by a predetermined value A, i.e., the calculation of FAF←FAF−A is carried out. The program then proceeds to a point 73. When the A/F is on the lean side, a predetermined value B is added to the factor FAF at a point 72, i.e., the calculation FAF←FAF+B is carried out, and the program proceeds to a point 73. Through the above-mentioned points 70 through 72, the A/F correction factor FAF is intergrated in regard to the time.

At the point 73, the CPU 44 compares the A/F signal in the previous operation cycle with the A/F signal of this cycle to discriminate whether the A/F signal was just inverted or not. When the A/F signal is not inverted, the program proceeds to a point 74 where the present correction factor FAF is stored in a predetermined region of the RAM 58. When the A/F signal is inverted, the program proceeds to a point 75 where a flag FSKIP, which indicates that the A/F is inverted, is set to "1". This FSKIP flag will be used in subsequent routine. The program then proceeds to a point 76 where the CPU 44 checks whether the A/F signal is inverted from the rich side into the lean side or not. When the A/F signal is inverted from the rich side into the lean side, the program proceeds to a point 77 where the correction factor FAF is increased by a predetermined value C, which is considerably greater than the above-mentioned predetermined value B. Namely, the point 77 performs the calculation FAF←FAF+C. When the A/F signal is inverted from the lean side into the rich side, on the other hand, the program proceeds to a point 78 where the correction factor FAF is reduced by a predetermined value D, which is considerably greater than the above-mentioned predetermined value A. Namely, at the point 78, the calculation FAF←FAF−D is performed.

The processings in the above-mentioned points 77 and 78 are called skip processings in which the A/F correction factor FAF is increased or decreased by the predetermined value C or D when the A/F signal is to be inverted, so that the convergence characteristics of the correction factor FAF are enhanced. The correction factor FAF, obtained through the processing of point 77 or 78, is stored in a predetermined region in the RAM 58 at a point 74.

Figure 5:
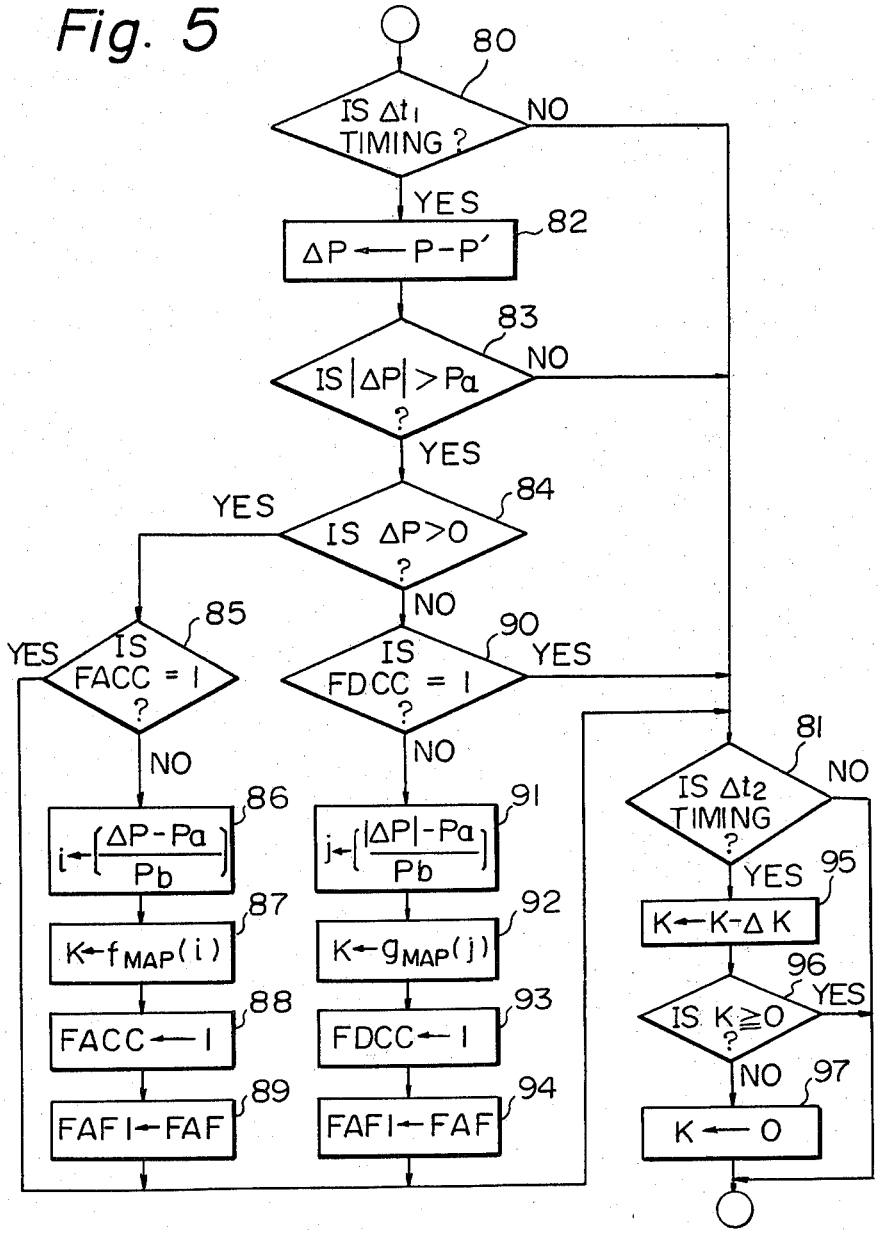
Figure 6:
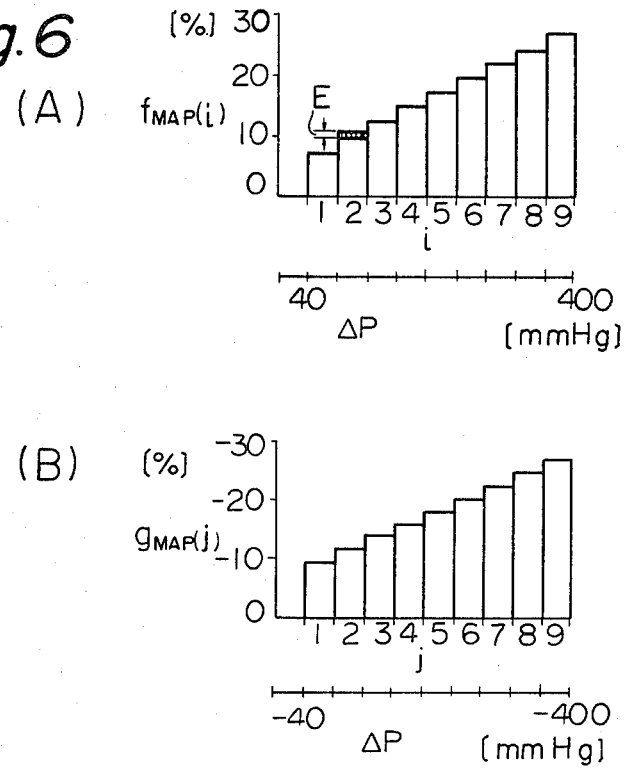
FIG. 6 contains two map diagrams illustrating characteristics with respect to transient correction factors.

FIG. 5 illustrates another part of the main routine 62 of FIG. 3. The routine of FIG. 5 is to calculate a transient correction factor (acceleration or deceleration correction factor) K which will be used for calculating the pulse width of the injection signal when the engine is under the accelerating or decelerating operating condition. At a point 80, the CPU 44 discriminates whether a sampling timing, for sampling the pneumatic pressure in the intake manifold, appears at every interval of $\Delta t$, seconds. When it is not the sampling timing, the program proceeds to a point 81. When it is the sampling timing, the program proceeds to a point 82 where a pressure difference $\Delta P$ is calculated between the latest, data of pneumatic absolute pressure P in the intake manifold stored in the RAM 58 and the data of the pneumatic absolute pressure P' in the previous sampling timing. That is, the point 82 performs the substraction $\Delta P \leftarrow P - P'$. Then, at a point 83, the CPU 44 discriminates whether the absolute value of $\Delta P$ is greater than a predetermined value Pa or not, to determine whether the engine is under the transient operating condition or not. When $|\Delta P| \leqq Pa$, i.e., when the engine is under a steady-state operation condition, the program proceeds to the point 81. When $|\Delta P| > Pa$, i.e., when the engine is under a transient operating condition, the program proceeds to a point 84, where it is discriminated whether $\Delta P$ assumes a positive value or a negative value to determine whether the engine is under the accelerating condition or the decelerating condition. When the engine is under the condition of acceleration, the program proceeds to a point 85 where it is discriminated whether a flag FACC for waiting the learning operation is "1" or not. The program proceeds to a point 86 only when FACC "1". At the point 86, the CPU 44 classifies the ranking of the acceleration degrees. That is, if the width of the acceleration rank is denoted by Pb, the acceleration rank i is calculated from $i \leftarrow [\Delta P - Pa/Pb]$. Then, at a point 87, the CPU 44 calculates the transient correction factor K corresponding to the rank i from an acceleration correction map $f_{MAP}(i)$ that is shown in FIG. 6(A) and that is stored in the RAM 58. As will be mentioned later, the map $f_{MAP}(i)$ is corrected by a learning operation. At a point 88, then, the CPU 44 sets the learning wait flag FACC to "1". Therefore, hereafter, the processings of the points 86, 87 and of a next point 89 are not executed until the map $f_{MAP}(i)$ is corrected by the learning operation. At the next point 89, the A/F correction factor FAF, at the time when the pulse-width of the injection signal is increased according to the transient correction factor K, which was calculated depending upon the acceleration degree, is stored as FAF1 in a predetermined region of the RAM 58. The value FAF1 will be used for executing the learning control operation that will be mentioned later.

When it is discriminated at the point 84 that the engine is under the condition of deceleration, the program proceeds to a point 90, where it is discriminated whether the learning wait flag FDCC has been set to "1" or not. The processings of points 91 through 94 are executed only when FDCC—"1". At the point 91, the rank j of the deceleration degree is calculated from $j \leftarrow [|\Delta P| - Pa/Pb]$, and at the point 92, the transient correction factor K corresponding to the rank j is calculated from a deceleration correction map $g_{MAP}(j)$ that is shown in FIG. 6(B) and that is stored in the RAM 58. The map $g_{MAP}(j)$ will also be corrected by a learning operation. At the point 93, the learning wait flag FDCC is set to "1", for the same reason as that given for the point 88. Then, at the point 94, the A/F correction factor FAF at the time when the pulse-width of the injection signal is decreased, according to the transient correction factor K calculated at the point 92, is stored as FAF1 in the RAM 58.

The steps 81, 95 though 97 execute a routine for gradually reducing the transient correction factor K with the lapse of time after the acceleration or deceleration has been finished. At the point 81, the CPU 44 discriminates whether it is a timing occurring with an interval of $\Delta t_2$ for attenuating the correction factor K. When it is at the timing of $\Delta t_2$, the transient correction factor K is decreased by a predetermined value $\Delta K$ at the point 95. Through the processings of points 95, 96 and 97, the correction factor K is gradually reduced until it becomes zero and thereafter is maintained at zero.

Figure 7:
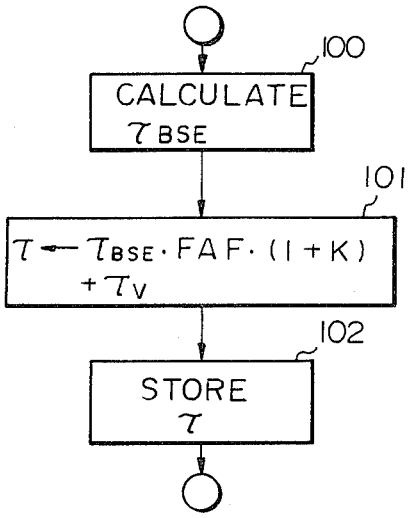
FIGS. 7 and 8 are flow diagrams illustrating parts of the control programs shown in FIG. 3.

The A/F correction factor FAF and the transient correction factor K, calculated according to the processing routines of FIGS. 4 and 5, are used for calculating the pulse-width of the injection signal, as shown in FIG. 7. That is, the CPU 44 executes the operation shown in FIG. 7 while the main routine is being carried out. First, at a point 100, the CPU 44 calculates the basic pulse-width $\tau_{BSE}$ of the injection signal by the interpolation method using a map relying upon the running speed N of the engine and the intake manifold pressure P. That is, the ROM 56 stores, beforehand, the following map of basic pulse widths $\tau_{BSE}$ (msec) relative to the running speed N and the intake manifold pressure P, such that the pulse width $\tau_{BSE}$ can be calculated by interpolation using the map relying upon th input data N and P which have been stored in the RAM 58.

| | P | | | | | | |
|---|---|---|---|---|---|---|---|
| N | 200 | 250 | 300 | 350 | 400 | ... | 750 |
| 800 | 2.0 | 2.3 | 2.6 | 3.0 | 3.5 | ... | 5.0 |
| 1200 | 2.0 | 2.3 | 2.6 | 3.0 | 3.5 | ... | 5.0 |
| 1600 | 2.1 | 2.4 | 2.7 | 3.1 | 3.6 | ... | 5.1 |
| 2000 | 2.1 | 2.4 | 2.7 | 3.1 | 3.6 | ... | 5.1 |
| 2400 | 2.1 | 2.4 | 2.7 | 3.1 | 3.6 | ... | 5.1 |
| 2800 | 2.2 | 2.5 | 2.8 | 3.2 | 3.7 | ... | 5.2 |
| 3200 | 2.2 | 2.5 | 2.8 | 3.2 | 3.7 | ... | 5.2 |
| . | . | . | . | . | . | | . |
| . | . | . | . | . | . | ... | . |
| . | . | . | . | . | . | | . |
| 6500 | 2.5 | 2.8 | 3.1 | 3.5 | 4.0 | ... | 5.5 |

P: mmHg abs.
N: r.p.m.

Then, at a point 101, the CPU 44 calculates a final pulse-width $\tau$ based upon the basic pulse-width $\tau_{BSE}$, the A/F correction factor FAF, the transient correction factor K, and the dead injection pulse-width $\tau_V$ of the injection valve, according to the following relation, $$\tau = \tau_{BSE} \cdot FAF \cdot (1 \cdot K) + \tau_V$$

where the transient correction factor K assumes a positive value during the acceleration and a negative value during the acceleration.

At a point 102, the CPU 44 stores the thus calculated data with respect to the pulse-width $\tau$ in a predetermined region of the RAM 58. The pulse-width data $\tau$ is read by the interrupt routine for fuel injection processing shown in FIG. 3, converted into a drive current, and is sent to the output port 52, such that the fuel feeding rate is controlled.

Figure 8:
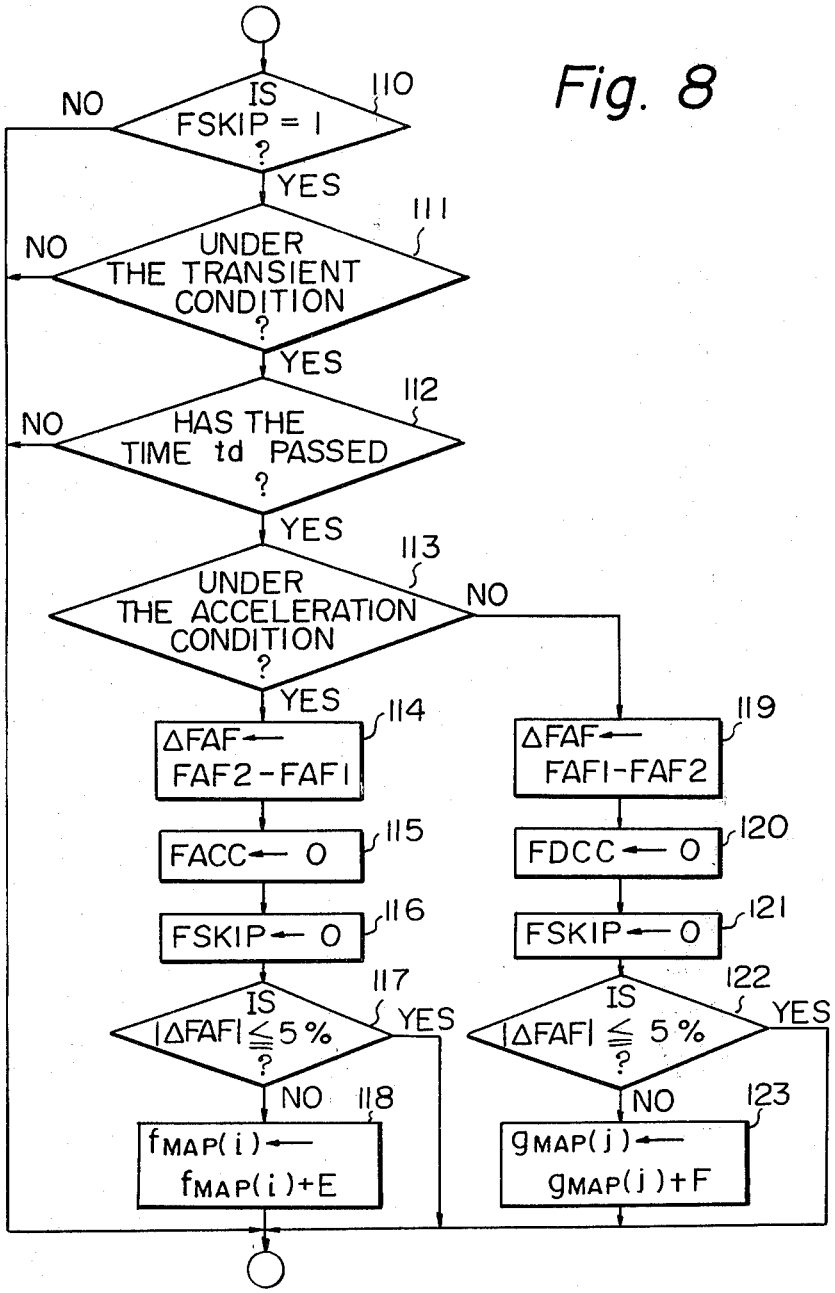

Below is illustrated a correction control routine of the learning operation with respect to the acceleration correction map $f_{MAP}(i)$ and the deceleration correction map $g_{MAP}(j)$, which makes the feature of the present invention. FIG. 8 illustrates a routine for operating the learning control, which will be executed while the main routine is being carried out. At a point 110, the CPU 44 checks the A/F inversion flag FSKIP to discriminate whether it is "1" or not. When FSKIP="1", i.e., when the A/F signal is just inverted, the program proceeds to a point 111, where it is discriminated whether the engine is under the condition of transient operation or not. The processing of point 111 may be carried out in the same manner as the processing of point 83 of FIG. 4, or it may be carried out by setting the flag that represents the transient operating condition which is discriminated by the point 83 and by simply checking the flag at the point 111. Then, at a point 112, the CPU 44 discriminates whether a predetermined period of time td has passed after the pulse-width had been increased or decreased according to the transient correction factor K. This is to cope with the lag in the feedback control of air-fuel ratio that will be caused by the time lag of from when the fuel is injected into the intake system until the fuel reaches the $O_2$ sensor in the exhaust system. When it is discriminated that a time longer than the time td has passed, the program proceeds to a point 113 where it is discriminated whether the engine is under the condition of acceleration or deceleration. When the engine is under the condition of acceleration, the processings of points 114 through 118 are carried out to correct the map $f_{MAP}(i)$, as required. First, at the point 114, the CPU 44 calculates a difference $\Delta FAF$ between the value FAF1 (stored at the point 89 of FIG. 5) at the time when the pulse-width was increased due to the acceleration, and a value FAF2 which is equal to the present A/F correction factor FAF equal to the A/F correction factor FAF just before the air-fuel ratio is inverted from the lean side to the rich side). That is, the CPU 44 performs the calculation ΔFAF←FAF2−FAF1 at the point 114. After the flags FACC and FSKIP are reset at the points 115 and 116, the CPU 44 discriminates whether the difference ΔFAF is smaller than 5%, at the point 117. When the difference ΔFAF is greater than 5%, the acceleration correction map $f_{MAP}(i)$ is increased by a predetermined value E, at the point 118. That is, the point 118 effects the processing $f_{MAP}(i) \leftarrow f_{MAP}(i)+E$. When FAF≦5%, the map $f_{MAP}(i)$ is not corrected.

When it is discriminated at the point 113 that the engine is under the condition of deceleration, the map $g_{MAP}(j)$ is corrected, as required. First, at a point 119, the CPU 44 calculates, according to a relation ΔFAF←FAF1−FAF2, a difference ΔFAF between the value FAF1 (value stored at the point 94 of FIG. 5) at the time when the pulse-width was decreased due to the deceleration and the value FAF2 which is equal to the present A/F correction factor FAF (equal to the A/F correction factor FAF just before the air-fuel ratio is inverted from the rich side to the lean side). Then, points 120 and 121 reset the flags FDCC and FSKIP, and a point 122 discriminates whether the difference ΔFAF is smaller than 5%. When ΔFAF>5%, the CPU 44 increases the deceleration correction map $g_{MAP}(j)$ by a predetermined value F at a point 123. That is, the point 123 performs the calculation $g_{MAP}(j) \leftarrow g_{MAP}(j)+F$. When ΔFAF≦5%, the map $g_{MAP}(j)$ is not corrected.

Figure 9:
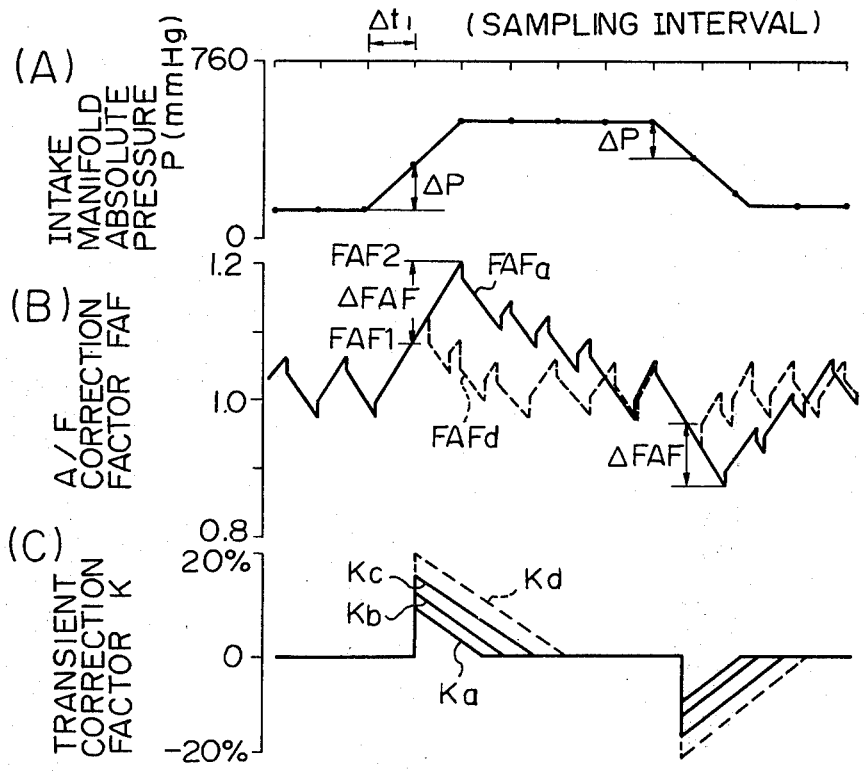
FIG. 9 is a wave-form diagram illustrating the operations of the control programs shown in FIG. 3.

As the processing routines of FIGS. 4, 5, 7 and 8 are repetitively executed while the main routine is being carried out, the learning control of the transient correction factor K is executed, so that the A/F correction factor FAF will converge within a predetermined range when the engine is under the condition of a acceleration or deceleration. FIG. 9 is a wave-form deagram for illustrating the above control operation. Let it now be assumed that the throttle valve is abruptly opened, i.e., the engine is under the condition of acceleration, and the intake manifold pressure P is raised by ΔP during the sampling interval $\Delta t_1$ as shown in FIG. 9(A). The rank i of the acceleration degree is thus found, and the transient correction factor K is calculated from the map $f_{MAP}(i)$ which is shown in FIG. 6(A). Symbol Ka in FIG. 9(C) represents the transient correction factor during the initial stage of the learning operation. When the fuel feeding rate is controlled by using the correction factor Ka, the A/F correction factor FAF undergoes a relatively greatly change during the period of acceleration, as represented by $FAF_a$ in FIG. 9(B). In this case, since ΔFAF becomes greater than 5%, the map $f_{MAP}(i)$ corresponding to the rank i of the acceleration degree is increased by a predetermined value E. For instance, if i=2, the map $f_{MAP}(2)$ of FIG. 6(A) is increased by a predetermined value E. Thereafter, when the acceleration of rank i=2 is developed, the corrected map $f_{MAP}(2)$ is used, and the transient correction factor becomes as indicated by Kb in FIG. 9(C). The same operation is repeated for every development of the acceleration of the acceleration rank i=2, and the map $f_{MAP}(2)$ is corrected successively. When the transient correction factor K becomes as indicated by a broken line of Kd, the A/F correction factor FAF becomes as indicated by a broken line of $FAF_d$ in FIG. 9(B), whereby the difference ΔFAF converges within 5%, and the learning of transient correction factor, related to the acceleration rank, is completed. The learning and correction are carried out in the same manner as described above for the map $f_{MAP}(i)$ of other acceleration ranks and for the map $g_{MAP}(j)$ under the deceleration condition. In the system for controlling the air-fuel ratio by feedback of this type, the change in the A/F correction factor FAF represents the change in the air-fuel ratio in an engine that is controlled depending upon the A/F correction factor FAF. Therefore, when the A/F correction factor FAF is converged within a predetermined range, the controlled air-fuel ratio is necessarily converged within a predetermined range without developing spikes.

In the above-mentioned embodiment, the intake manifold pressure is used to discriminate whether the engine is under the transient operating and to discriminate the degree of the transient condition. The above discrimination, however, may be carried out relying upon the rate for opening the throttle valve or the flow rate of the intake air.

According to the present invention, as illustrated in detail in the foregoing, the map for obtaining the transient correction factor is corrected depending upon the converging state of the A/F correction factor and, hence, the transient correction factor is controlled in a manner of the learning control operation. Accordingly, it is possible to always maintain an optimum air-fuel ratio under transient operating conditions, irrespective of variance in the control characteristics of the engine or the change in the characteristics with the lapse of time. Moreover, the present invention enables the transient correction factor to be determined very easily during the stage of designing.

As many widely different embodiments of the present invention may be constructed without departing from the spirit and scope of the present invention, it should be understood that the present invention is not limited to the specific embodiments described in this specification, except as defined in the appended claims.

We claim:

1. A method for controlling the air-fuel ratio in an internal combustion engine comprising the steps of:

detecting the running speed of the engine for producing a first electrical signal which indicates the detected speed;

detecting the intake manifold pneumatic pressure of the engine for producing a second electrical signal which indicates the detected pressure;

detecting the concentration of a predetermined component in the exhaust gas for producing a third electrical signal which indicates the detected concentration;

detecting the degree of the acceleration or deceleration of the engine for producing a fourth electrical signal which indicates the detected acceleration or deceleration degree;

calculating, depending upon the first and second electrical signals, a value which corresponds to a basic fuel feeding rate to the engine;

calculating, depending upon the third electrical signal, a first correction factor which corresponds to the deviation of the actual air-fuel ratio in the engine from a desired air-fuel ratio;

judging, depending upon the fourth electrical signal, whether or not the engine is under the accelerating or decelerating condition;

when the engine is under the accelerating or decelerating condition, calculating, depending upon the fourth electrical signal, a second correction factor by using a function which represents a relationship between the acceleration or deceleration degree and the second correction factor;

correcting the calculated value related to the fuel feeding rate in accordance with the calculated first correction factor;

when the engine is under the accelerating or decelerating condition, correcting the corrected value related to the fuel feeding rate in accordance with the calculated second correction factor;

adjusting, depending upon the corrected value related to the fuel feeding rate, the actual fuel feeding rate to the engine;

repeating the above sequence of steps so that the air-fuel ratio in the engine is controlled within a predetermined range;

detecting the change of the first correction factor during the accelerating or decelerating condition; and correcting, in response to the detected change of the first correction factor, said function related to the second correction factor.

2. A method as claimed in claim 1, wherein said function correcting step includes a step of correcting the function related to the second correction factor by a predetermined value, only when the detected change of the first correction factor is larger than a predetermined value.

3. A method as claimed in claim 1, wherein said function correcting step includes a step of correcting the function so that the second correction factor corresponding to the same acceleration or deceleration degree is increased by a predetermined value, only when the detected change of the first correction factor is larger than a predetermined value.

4. A method as claimed in claim 1, wherein said acceleration or deceleration degree detecting step includes a step of detecting the change of the second electrical signal at a predetermined interval.

5. A method as claimed in claim 1, wherein said second correction factor calculating step includes the steps of:

calculating, depending upon the fourth electrical signal, the second correction factor by using a function which represents a relationship between the acceleration or deceleration degree and the second correction factor during the accelerating or decelerating condition; and gradually decreasing the second correction factor with the lapse of time after the accelerating or decelerating condition.

6. An apparatus for controlling the air-fuel ratio in an internal combustion engine comprising:

means for detecting the running speed of the engine for producing a first electrical signal which indicates the detected speed;

means for detecting the intake manifold pneumatic pressure of the engine for producing a second electrical signal which indicates the detected pressure;

means for detecting the concentration of a predetermined component in the exhaust gas for producing a third electrical signal which indicates the detected concentration;

means for detecting the degree of the acceleration or deceleration of the engine for producing a fourth electrical signal which indicates the detected acceleration or deceleration degree;

processing means for (1) calculating, depending upon the first and second electrical signals, a value which corresponds to a basic fuel feeding rate to the engine; (2) calculating, depending upon the third electrical signal, a first correction factor which corresponds to the deviation of the actual air-fuel ratio in the engine from a desired air-fuel ratio; (3) judging, depending upon the fourth electrical signal, whether or not the engine is under the accelerating or decelerating condition; (4) when the engine is under the accelerating or decelerating condiditon, calculating, depending upon the fourth electrical signal, a second correction factor by using a function which represents a relationship between the acceleration or deceleration degree and the second correction factor; (5) correcting the calculated value related to the fuel feeding rate in accordance with the calculated first correction factor; and (6) when the engine is under the accelerating or decelerating condition, correcting the corrected value related to the fuel feeding rate in accordance with the calculated second correction factor;

means for adjusting, depending upon the corrected value related to the fuel feeding rate, the actual fuel feeding rate to the engine;

means for detecting the change of the first correction factor during the accelerating or decelerating condition; and means for correcting, in response to the detected change of the first correction factor, said function related to the second correction factor.

7. An apparatus as claimed in claim 6, wherein said function correcting means includes means for correcting the function related to the second correction factor by a predetermined value, only when the detected change of the first correction factor is larger than a predetermined value.

8. An apparatus as claimed in claim 6, wherein said function correcting means includes means for correcting the function so that the second correction factor corresponding to the same acceleration or deceleration degree is increased by a predetermined value, only when the detected change of the first correction factor is larger than a predetermined value.

9. An apparatus as claimed in claim 6, wherein said processing means for detecting the acceleration or deceleration degree includes means for detecting the change of the second electrical signal at a predetermined interval.

10. An apparatus as claimed in claim 6, wherein said processing means for calculating the second correction factor includes:

means for calculating, depending upon the fourth electrical signal, the second correction factor by using a function which represents a relationship between the acceleration or deceleration degree and the second correction factor during the accelerating or decelerating condition; and means for gradually decreasing the second correction factor with the lapse of time after the accelerating or decelerating condition.

* * * * *